US011197567B2

(12) United States Patent
Lemieux

(10) Patent No.: US 11,197,567 B2
(45) Date of Patent: Dec. 14, 2021

(54) PACKAGE RECEIVING APPARATUS

(71) Applicant: Bernard J Lemieux, Scottsdale, AZ (US)

(72) Inventor: Bernard J Lemieux, Scottsdale, AZ (US)

( * ) Notice: Subject to any disclaimer, the term of this patent is extended or adjusted under 35 U.S.C. 154(b) by 11 days.

(21) Appl. No.: 16/699,485

(22) Filed: Nov. 29, 2019

(65) Prior Publication Data

US 2020/0170434 A1 Jun. 4, 2020

Related U.S. Application Data

(60) Provisional application No. 62/772,708, filed on Nov. 29, 2018.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01); *A47G 2029/145* (2013.01)

(58) Field of Classification Search
CPC .... A47G 29/20; A47G 29/141; A47G 29/124; A47G 2029/144; A47G 2029/145; B65D 29/04; B65D 29/00; B65D 33/28; G07C 9/00912; E05B 65/0075; E06B 2009/002; E06B 9/08
USPC ..... 232/17, 19, 45; 383/117, 76; 70/64, 65; 109/59 R; 160/98
See application file for complete search history.

(56) References Cited

U.S. PATENT DOCUMENTS 5,492,272 A * 2/1996 Fewer ..... A47G 29/12 232/19
5,636,679 A * 6/1997 Miller ..... E06B 9/08 160/23.1
6,089,302 A * 7/2000 Britt ..... E06B 9/08 160/28
6,666,466 B1 * 12/2003 Rainho ..... B62B 1/14 280/47.27
6,928,415 B1 * 8/2005 Liberman ..... A47G 29/141 383/120
10,076,204 B1 * 9/2018 Sadeghi ..... A47G 29/141
10,093,454 B1 * 10/2018 Kalyan ..... A47G 29/14
10,653,261 B2 * 5/2020 Loures ..... E05B 67/383
10,786,104 B1 * 9/2020 Pappas ..... B65D 29/04
2005/0173078 A1 * 8/2005 Perez, Jr. ..... A01K 3/00 160/99
2010/0006636 A1 * 1/2010 Frankenberg ..... A47G 29/22 232/44
2013/0077896 A1 * 3/2013 Wiley ..... A47G 29/20 383/86.2
2016/0331171 A1 * 11/2016 Jiang ..... G06Q 10/0833

(Continued)

*Primary Examiner* — William L Miller
(74) *Attorney, Agent, or Firm* — Parsons & Goltry; Robert Parsons; Michael Goltry

(57) ABSTRACT

Package receiving apparatus including a housing and a net retracting element mounted within the housing. An elongated flexible net has a first end attached to the net retracting element within the housing and a second end extending through an opening in the housing with a pull-bar or locking-bar attached thereto external to the housing. A locking mechanism is mounted on one of an exterior surface of the housing or an exterior surface of an adjacent structure and the locking mechanism is constructed to receive and lock the pull-bar or locking-bar with the net extended.

11 Claims, 4 Drawing Sheets

(56) References Cited

U.S. PATENT DOCUMENTS

| | | | | |
|---|---|---|---|---|
| 2017/0106979 | A1* | 4/2017 | Seger | B64D 1/12 |
| 2018/0029760 | A1* | 2/2018 | Maser | G08B 13/06 |
| 2018/0177318 | A1* | 6/2018 | Chambers | A47G 29/30 |
| 2018/0202199 | A1* | 7/2018 | Critz | B65D 33/34 |
| 2019/0038062 | A1* | 2/2019 | Sundaresan | A47G 29/1225 |
| 2019/0133362 | A1* | 5/2019 | Gilligan | A47G 29/141 |
| 2019/0233111 | A1* | 8/2019 | High | B64D 1/12 |
| 2020/0015617 | A1* | 1/2020 | Izquierdo Gonzalez | A47G 29/20 |
| 2020/0060460 | A1* | 2/2020 | Farrar | A47G 29/141 |
| 2020/0388095 | A1* | 12/2020 | Agbeyo | G08B 3/10 |
| 2020/0390313 | A1* | 12/2020 | Pappas | A47L 23/263 |

* cited by examiner

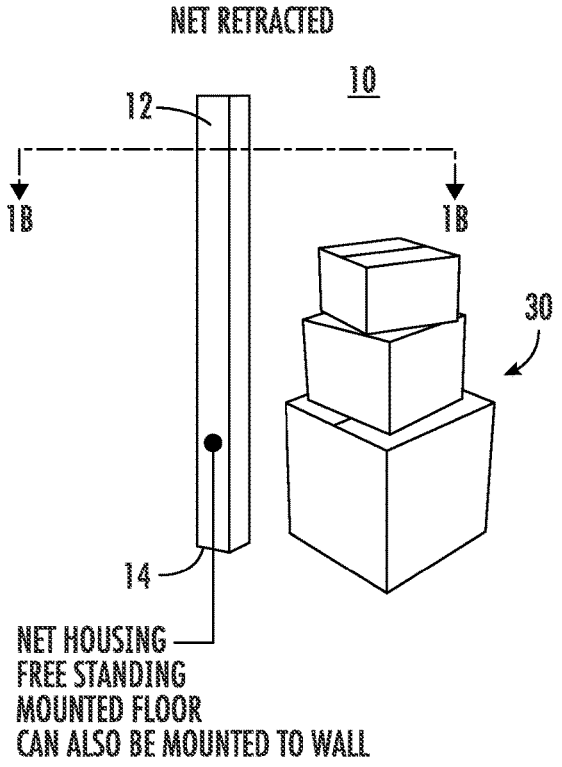
FIG. 1A
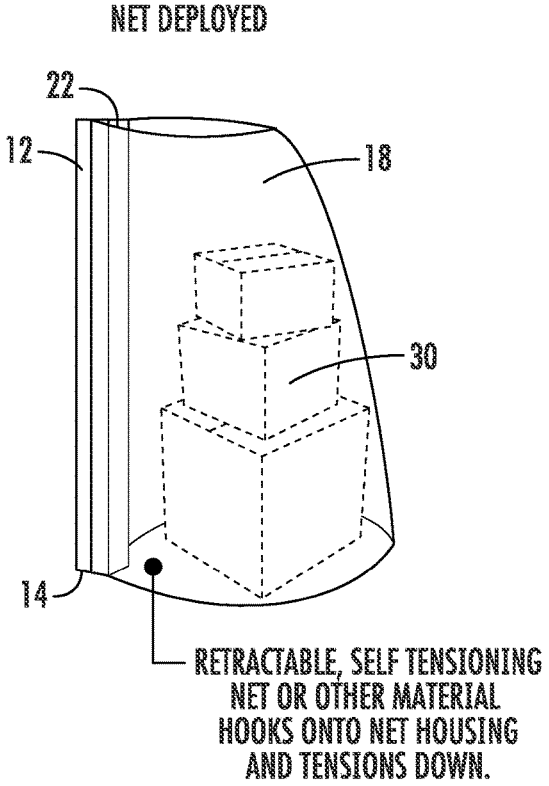
FIG. 2
FIG. 1B
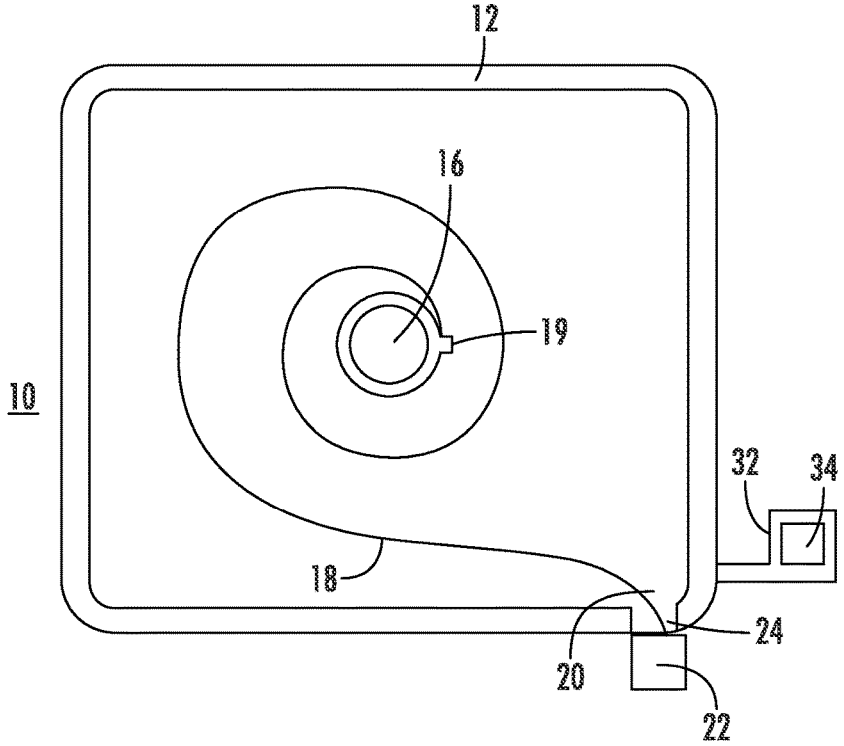

NET RETRACTED

NET DEPLOYED

PACKAGE RECEIVING APPARATUS

CROSS-REFERENCE TO RELATED APPLICATION

This application claims the benefit of U.S. Provisional Patent Application No. 62/772,708, filed 29 Nov. 2018.

FIELD OF THE INVENTION

This invention relates to package receiving apparatus and more specifically to a package receiving delivery net.

BACKGROUND OF THE INVENTION

At the present time the delivery of packages to houses, apartments, lobbies or package rooms of businesses or hotels, etc., is very common. The packages may be products ordered by telephone or email from companies, gifts, etc. In many instances the company, FedEx, Ups, the U.S. Post Office may not have time to wait for a person to answer the door or there may not be anyone home. In such instances the package is simply left at the door. The problem is that unscrupulous people may notice the package standing at the door and simply take it.

Some attempts to remedy this problem have been proposed, such as, for example, disclosed in U.S. Pub. 2016/0331171, entitled "Package Receiving Systems and Method", published Nov. 17, 2016. A major problem with most of these types of prior art devices is that they are extremely large and cumbersome as well as expensive. It is understood that whatever system may be employed to protect delivered packages must remain outside near the door to which the packages will be delivered and must be available at all times to the delivering company. Generally, prior art devices enclose delivered packages in a container-like enclosure which is relatively large (especially if large packages are expected) even when in a storage orientation. Thus, large and cumbersome systems will be a continual obstruction adjacent the door.

It would be highly advantageous, therefore, to remedy this and other deficiencies inherent in the prior art.

Accordingly, it is an object of the present invention to provide new and improved package receiving apparatus.

It is another object of the present invention to provide new and improved package receiving apparatus that is conveniently storable adjacent an exterior door.

SUMMARY OF THE INVENTION

Briefly to achieve the desired objects and advantages of the instant invention package receiving apparatus is illustrated and disclosed. The package receiving apparatus includes a housing having an opening through the housing, a net retracting element mounted within the housing, an elongated flexible net having a first end attached to the net retracting element within the housing and a second end extending through the opening in the housing with a pull-bar or locking-bar attached thereto external to the housing, and a locking mechanism mounted on one of an exterior surface of the housing or an exterior surface of an adjacent structure, the locking mechanism being constructed to receive and lock the pull-bar or locking-bar with the net extended.

The desired objects and advantages of the instant invention are further achieved in a preferred embodiment of package receiving apparatus including a vertically elongated hollow housing having a vertically elongated opening through the housing and a net retracting element including an elongated spindle or shaft rotatably mounted within the housing, the elongated spindle or shaft being spring loaded. An elongated flexible net generally rectangular in shape with a vertical width or height and a length sufficient to enclose any packages being received is included. The elongated flexible net has a first end attached to the elongated spindle or shaft within the housing and a second end extending through the vertically elongated opening in the housing with a pull-bar or locking-bar attached thereto external to the housing. The elongated flexible net is wrapped around the elongated spindle or shaft in a retracted or stored configuration. A locking mechanism is mounted on one of an exterior surface of the housing or an exterior surface of an adjacent structure and is constructed to receive and lock the pull-bar or locking-bar with the net extended. The elongated spindle or shaft is spring loaded to automatically retract the elongated flexible net when the locking-bar is released from the locking mechanism.

The desired objects and advantages of the instant invention are further achieved in a method of protecting received packages including the step of providing package receiving apparatus including a housing having an opening through the housing, a net retracting element mounted within the housing, an elongated flexible net having a first end attached to the net retracting element within the housing and a second end extending through the opening in the housing with a pull-bar or locking-bar attached thereto external to the housing, and a locking mechanism, the locking mechanism being constructed to receive and lock the pull-bar or locking-bar with the net extended. The method further includes the steps of fixedly attaching the housing to a floor or wall adjacent a door opening and fixedly attaching the locking mechanism to one of an exterior surface of the housing or an exterior surface of an adjacent structure, whereby the elongated flexible net is extended to enclose packages when the pull-bar or locking-bar is engaged with the locking mechanism.

BRIEF DESCRIPTION OF THE DRAWINGS

Specific objects and advantages of the invention will become readily apparent to those skilled in the art from the following detailed description of a preferred embodiment thereof, taken in conjunction with the drawings in which:

FIG. 1A is a front perspective view of the package receiving apparatus, in accordance with the present invention, in a retracted or stored orientation;

FIG. 1B is an enlarged cross sectional view of the package receiving apparatus of FIG. 1 as seen along the line 1B-1B;

FIG. 2 is a front perspective view of the package receiving apparatus of FIG. 1 in a deployed or extended orientation;

DETAILED DESCRIPTION OF THE DRAWINGS

Figure 4:
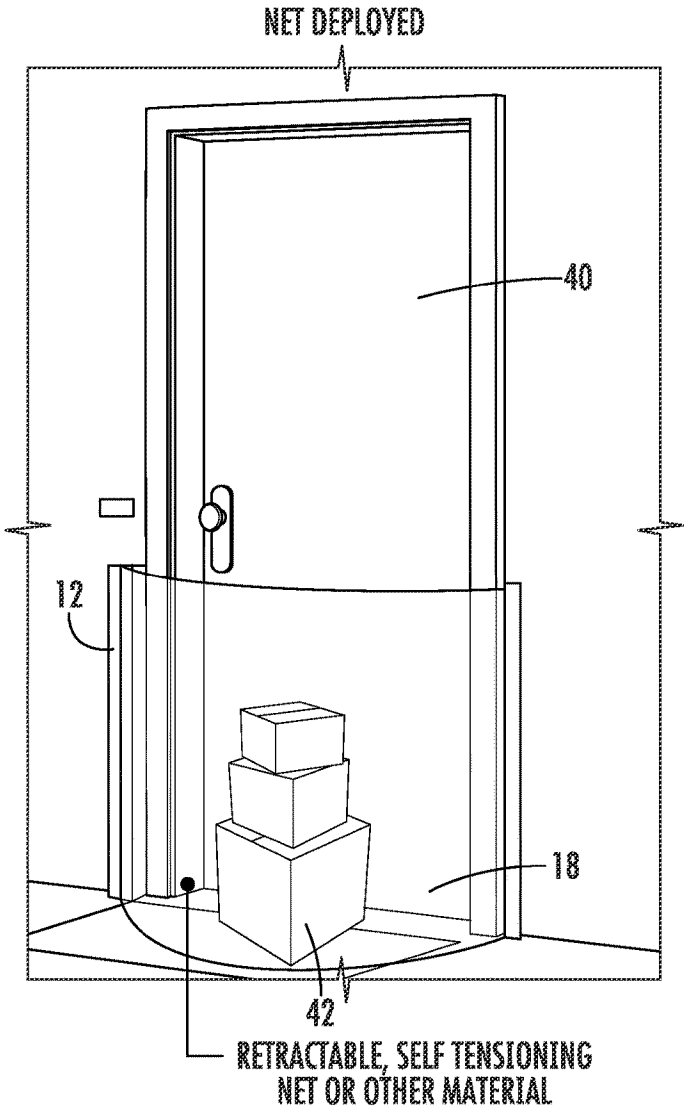
FIG. 4 is a front perspective view of the package receiving apparatus of FIG. 3 in a deployed or extended orientation.

Turning to the drawings and specifically to FIGS. 1A and 1B, package receiving apparatus 10 is illustrated in a retracted or stored orientation. Apparatus 10 includes a vertically elongated hollow housing 12, in this specific example affixed at a lower end 14 to a floor (e.g. porch, patio, wood floor, etc.). Generally, housing 12 will be constructed with a tamper proof design and of material that is rigged and rugged (e.g. metal, hardwood, hard plastic, etc.). Net retracting element 16 can be any structure capable of allowing the ready deployment of an elongated flexible net 18, one end of which is attached to element 16, and retracting elongated flexible net 18 after deployment. In this preferred embodiment, net retracting element 16 is an elongated shaft, also designated 16 for convenience of understanding, which is rotatably mounted approximately centrally within housing 12 and extends approximately the length of housing 12. It will be understood that net retracting element 16 can be any structure capable of retracting and storing elongated flexible net 18 and allowing the ready deployment thereof. In a preferred embodiment the upper end of shaft 16 is rotatably affixed in the upper end of housing 12 and the lower end is rotatably affixed in a lower end of housing 12 to thereby provide a secure mounting.

Elongated rectangularly shaped flexible net 18 is provided that has a width approximately the length of shaft and a length sufficient to completely surround or enclose any expected packages (as described further below). Net 18 is affixed at one end 19 to shaft 16 and is rolled around shaft 16 in a retracted or partially retracted orientation with the opposite end 20 attached to a pull-bar or locking-bar 22 which is externally accessible. That is, net 18 extends through a vertically elongated opening 24 in housing 12 and engages locking-bar 22 external to housing 12. In the preferred embodiment, shaft 16 is spring-loaded so that net 18 can be drawn outwardly from housing 12 any distance desired (i.e. to surround a package or packages) and will automatically retract or rewind around shaft 12 as it is released. Further, in this preferred embodiment the spring-loading of shaft 12 is biased to hold locking-bar 22 tightly in opening 24 of housing 12 when net 18 is completely retracted. While spring loaded spindle or shaft 16 is preferred, it will be understood that shaft 16 can be rotated to retract net 18 manually, such as using a crank, or it can be motorized, such as being rotated by a motor, electric motor and the like.

Referring additionally to FIG. 2, net 18 is extracted from housing 12 by pulling on locking-bar 22 and extracted net 18 is deployed around a package or packages 30 (see FIG. 1A) with locking-bar 22 engaged in a catch or locking mechanism 32 (see FIG. 1B). With net 18 deployed completely around packages 30, locking-bar 22 is engaged in locking mechanism 32 which fixedly holds locking-bar 22 in the engaged position. Locking mechanism 32 may include, for example, a tension lock 34 operable by any or all of a key, keypad, Bar Code Scanner, or any other releasable devices that will allow any authorized individual to release tension lock 34 and free packages 30. Here it will be understood that a Bar Code Scanner may be the most convenient locking system that will grant access to delivery companies in the event that additional packages may be added or exchanged.

Housing 12 is preferably a weather and tamper resistant structure which may be, for example, anodized aluminum, powder coated steel, or the like. While housing 12 is illustrated as having a generally rectangularly shaped cross-section, it will be understood that other configurations might be designed to further conceal or camouflage the structure during nonuse. Further, housing 12 may be provided with different skins to provide different looks depending upon the specific application. For example, the outer surface of housing 12 might be the same color as the house or other structure it is mounted adjacent so that in a retracted or stored orientation it would be practically unnoticeable.

Net 18 is preferably an industrial non-tangling net, mesh fabric, or other material that conforms to the packages being protected (e.g. packages 30). In the preferred embodiment, net 18 includes elastic bands along the top and bottom edges to help securely encase packages. While elastic bands are described, it will be understood that metal or plastic wire or bands can be employed that can be tightened to cinch net 18 around the packages. Also, in the preferred embodiment, openings in net 18 will be smaller than 4 inches to ensure that it is child proof. For energizing any electrical components included, package receiving apparatus 10 can be hard wired to a standard electrical system, or it can be energized by batteries, solar cells, etc.

Figure 3:
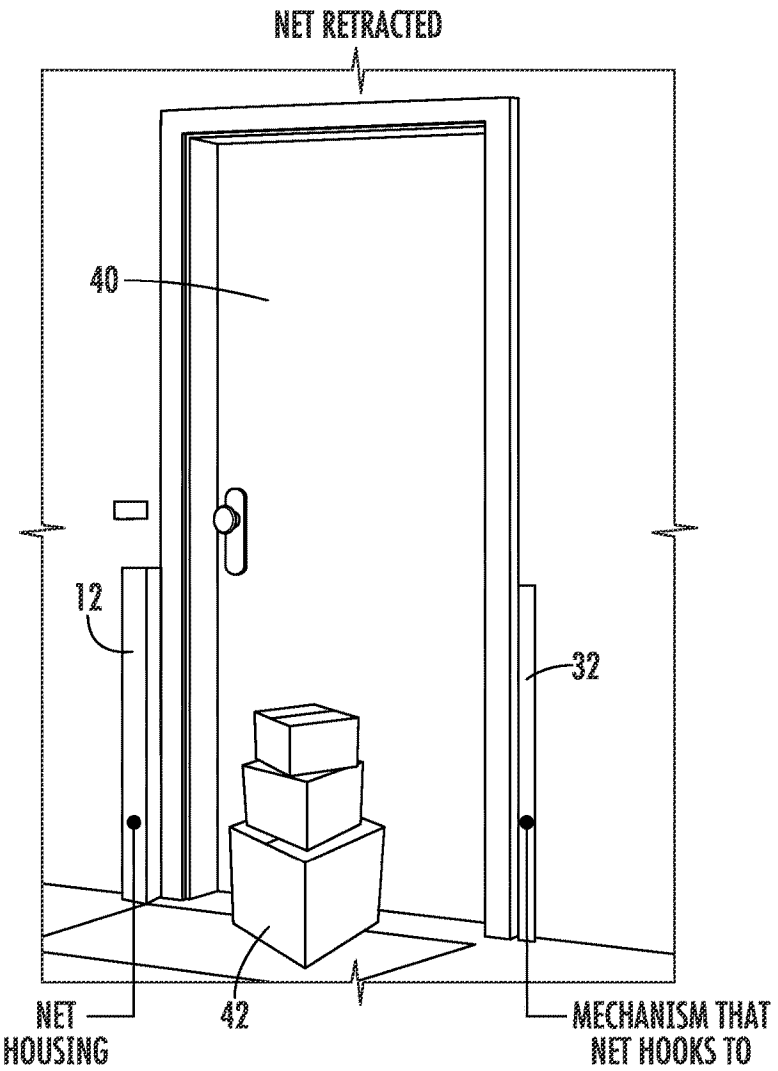
FIG. 3 is a front perspective view of the package receiving apparatus in a wall mounted configuration over a door, in accordance with the present invention, in a retracted or stored orientation.
Figure 6:
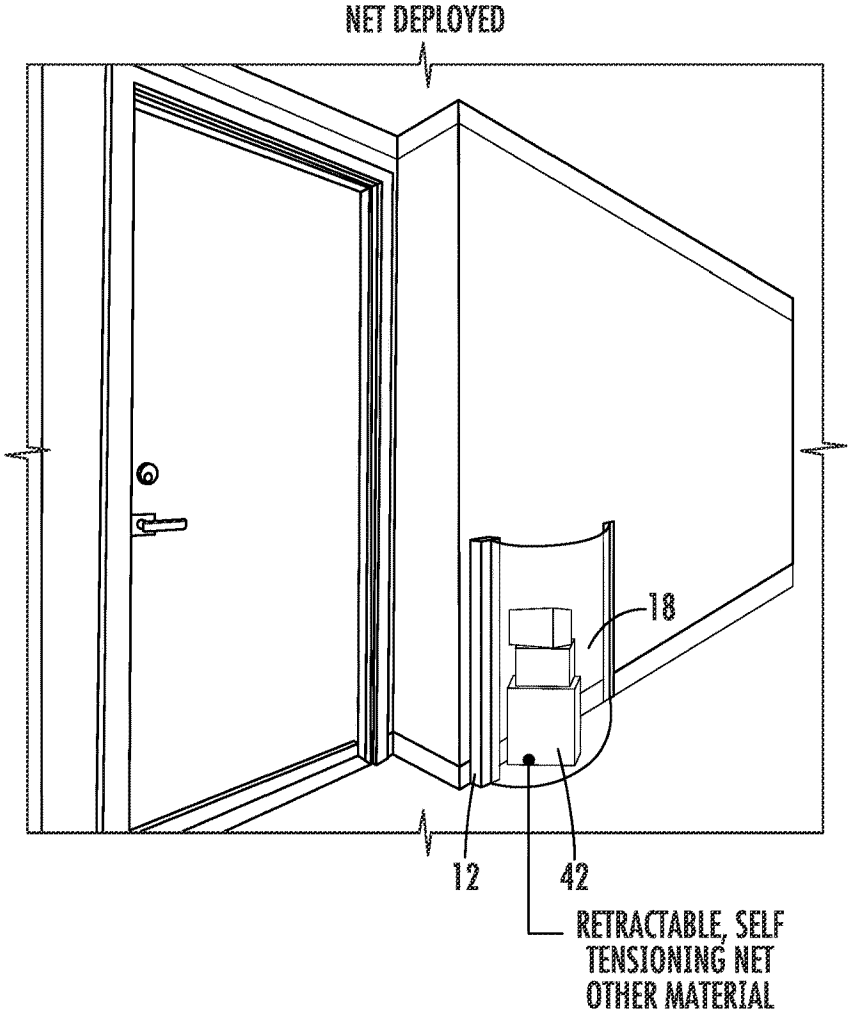
FIG. 6 is a front perspective view of the package receiving apparatus of FIG. 5 in a deployed or extended orientation.
Figure 5:
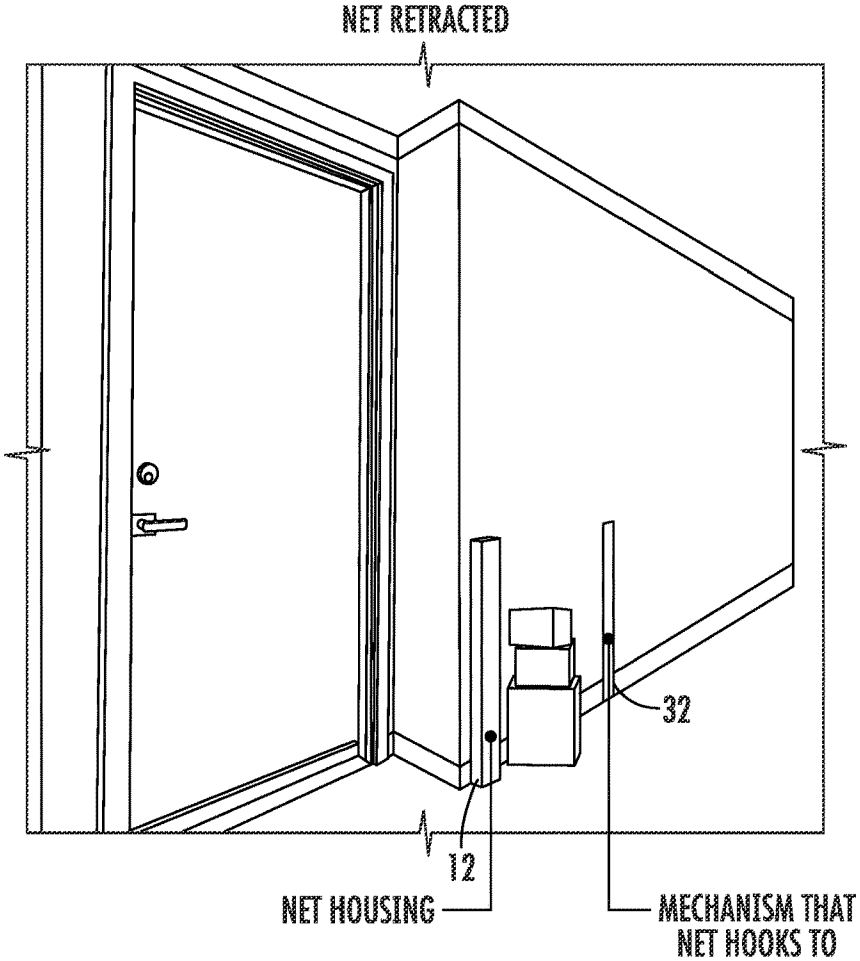
FIG. 5 is a front perspective view of the package receiving apparatus in a wall mounted configuration, in accordance with the present invention, in a retracted or stored orientation.
Figure 7:
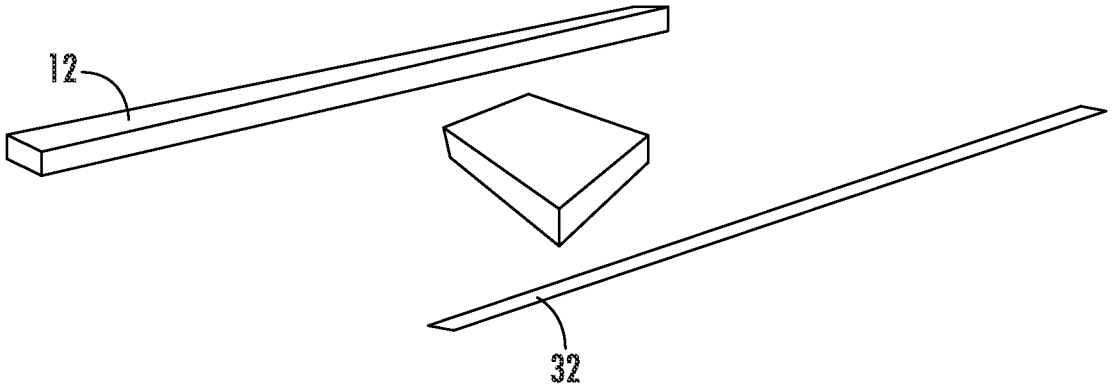
FIG. 7 is a front perspective view of the package receiving apparatus in a floor mounted configuration, in accordance with the present invention, in a retracted or stored orientation.
Figure 8:
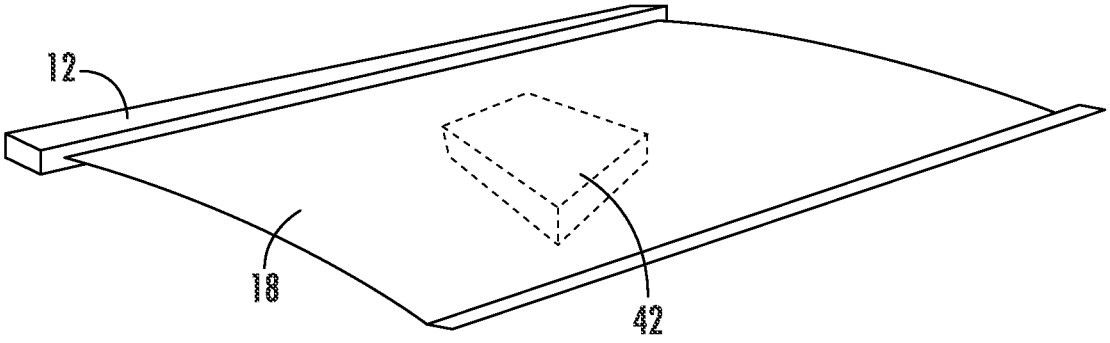
FIG. 8 is a front perspective view of the package receiving apparatus of FIG. 7 in a deployed or extended orientation.

Turning to FIG. 3, another example of an application for package receiving apparatus 10 is illustrated. In this example, housing 12 is attached to a wall at one side of a door 40, which may be for the entrance of a house, an apartment, a lobby or package room of businesses or hotels, etc. In this application, locking mechanism 32 is attached to a wall on the opposite side of door 40. In operation, the delivering business operative places package or packages 42 in front of door 40 and then pulls locking bar 22, along with net 18, from housing 12 across door 40 and engages the locking-bar in locking mechanism 32, as illustrated in FIG. 4. Here it will be understood that the same arrangement could simply be mounted on a wall adjacent the door as shown in FIGS. 5 and 6 or a section of floor as shown in FIGS. 7 and 8. The distance between housing 12 and locking mechanism 32 is not critical since net 18 is sufficiently long and only requires sufficient distance to encircle any sized packages expected. Many other mounting arrangements may be devised and the arrangements described herein are for example only.

A method of utilizing the described package receiving apparatus to protect received packages includes the following steps. Initially the package receiving apparatus including a housing having an opening through the housing, a net retracting element mounted within the housing, an elongated flexible net having a first end attached to the net retracting element within the housing and a second end extending through the opening in the housing with a pull-bar or locking-bar attached thereto external to the housing, and a locking mechanism, the locking mechanism being constructed to receive and lock the pull-bar or locking-bar with the net extended is provided. The housing is fixedly attached, for example see FIGS. 3 and 5, to a wall adjacent a door opening and/or a floor. The locking mechanism is fixedly attached, for example see FIGS. 1B, 3 and 5, to one of an exterior surface of the housing or an exterior surface of an adjacent structure, whereby the elongated flexible net is extended to enclose packages when the pull-bar or locking-bar is engaged with the locking mechanism, as illustrated in FIGS. 2, 4, and 6.

Additional elements can be provided to increase security and notice to the package receiver. A security camera can be carried by housing 12 that activates on motion, tampering, or activation of the unit. Upon activation, a signal can be sent to a specific app that would let the owner know something has occurred, such as a delivery or an attempted theft, and the like. A doorbell can also be carried by the housing 12 which is activated upon delivery to notify the receiver of a delivery.

Thus, the present invention discloses and provides a new and improved package receiving apparatus. The new and improved package receiving apparatus is conveniently storable/mountable adjacent any convenient exterior door and can be designed to be nearly or substantially unnoticeable during periods of nonuse. Further, the present package receiving apparatus does not in any way obstruct door-ways, passage-ways, or the like in a non-use orientation.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Package receiving apparatus comprising:

a housing having an opening through the housing;

a net retracting element mounted within the housing;

an elongated flexible net having a first end attached to the net retracting element within the housing and a second end extending through the opening in the housing with a pull-bar or locking-bar attached thereto external to the housing; and a locking mechanism mounted on one of an exterior surface of the housing or an exterior surface of an adjacent structure, the locking mechanism being constructed to receive and lock the pull-bar or locking-bar with the net extended, wherein the locking mechanism includes a tension lock operable by any or all of a key, keypad, or Bar Code Scanner.

2. Package receiving apparatus as claimed in claim 1 wherein the net retracting element includes an elongated spindle or shaft rotatably mounted within the housing and the elongated flexible net is wrapped around the elongated spindle or shaft in a retracted or stored configuration.

3. Package receiving apparatus as claimed in claim 2 wherein the elongated spindle or shaft is spring loaded to automatically retract the elongated flexible net when the locking-bar is released from the locking mechanism.

4. Package receiving apparatus comprising:

a housing having an opening through the housing;

a net retracting element mounted within the housing;

an elongated flexible net having a first end attached to the net retracting element within the housing and a second end extending through the opening in the housing with a pull-bar or locking-bar attached thereto external to the housing, wherein the elongated flexible net includes one of an industrial non-tangling net or mesh fabric that conforms to packages being protected, and wherein the elongated flexible net includes one of elastic bands or metal or plastic wire or bands that can be tightened to cinch the elongated flexible net around packages; and a locking mechanism mounted on one of an exterior surface of the housing or an exterior surface of an adjacent structure, the locking mechanism being constructed to receive and lock the pull-bar or locking-bar with the net extended.

5. Package receiving apparatus as claimed in claim 1 wherein the housing is fixedly attached to a wall adjacent a door opening.

6. Package receiving apparatus as claimed in claim 1 wherein the elongated flexible net is generally rectangular in shape with a vertical width or height and a length sufficient to enclose any packages being received.

7. Package receiving apparatus as claimed in claim 6 wherein the housing is a vertically elongated hollow housing and the opening is a vertically elongated opening at least as long as the vertical width or height of the elongated flexible net.

8. Package receiving apparatus comprising:

a vertically elongated hollow housing having a vertically elongated opening through the housing;

a net retracting element including an elongated spindle or shaft rotatably mounted within the housing, the elongated spindle or shaft being spring loaded;

an elongated flexible net generally rectangular in shape with a vertical width or height and a length sufficient to enclose packages being received, the elongated flexible net having a first end attached to the elongated spindle or shaft within the housing and a second end extending through the vertically elongated opening in the housing with a pull-bar or locking-bar attached thereto external to the housing, the elongated flexible net being wrapped around the elongated spindle or shaft in a retracted or stored configuration;

a locking mechanism mounted on one of an exterior surface of the housing or an exterior surface of an adjacent structure, the locking mechanism being constructed to receive and lock the pull-bar or locking-bar with the net extended, the locking mechanism including a lock operable by any or all of a key, keypad, or Bar Code Scanner; and the elongated spindle or shaft is spring loaded to automatically retract the elongated flexible net when the locking-bar is released from the locking mechanism.

9. Package receiving apparatus as claimed in claim 8 wherein the elongated flexible net includes one of an industrial non-tangling net or mesh fabric that conforms to packages being protected.

10. Package receiving apparatus as claimed in claim 8 wherein the housing is fixedly attached to a wall adjacent a door opening.

11. Package receiving apparatus comprising:

a vertically elongated hollow housing having a vertically elongated opening through the housing;

a net retracting element including an elongated spindle or shaft rotatably mounted within the housing, the elongated spindle or shaft being spring loaded;

an elongated flexible net generally rectangular in shape with a vertical width or height and a length sufficient to enclose packages being received, the elongated flexible net having a first end attached to the elongated spindle or shaft within the housing and a second end extending through the vertically elongated opening in the housing with a pull-bar or locking-bar attached thereto external to the housing, the elongated flexible net being wrapped around the elongated spindle or shaft in a retracted or stored configuration, wherein the elongated flexible net includes one of elastic bands or metal or plastic wire or bands that can be tightened to cinch the elongated flexible net around packages;

a locking mechanism mounted on one of an exterior surface of the housing or an exterior surface of an adjacent structure, the locking mechanism being constructed to receive and lock the pull-bar or locking-bar with the net extended; and the elongated spindle or shaft is spring loaded to automatically retract the elongated flexible net when the locking-bar is released from the locking mechanism.

* * * * *